US006193426B1

(12) United States Patent
Guillemin

(10) Patent No.: US 6,193,426 B1
(45) Date of Patent: Feb. 27, 2001

(54) METHOD OF DETERMINING OPTIMUM TIME FOR REPLACING THE MEDIA FEED ROLLER OF A PRINTING DEVICE

(75) Inventor: Gustavo M. Guillemin, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/408,155

(22) Filed: Sep. 29, 1999

(51) Int. Cl.[7] ..... B41J 11/50

(52) U.S. Cl. ..... 400/605; 400/703; 271/258.01; 271/258.04

(58) Field of Search ..... 400/605, 625, 400/636, 703; 101/479; 271/258.01, 258.04, 122

(56) References Cited

U.S. PATENT DOCUMENTS 5,335,043 * 8/1994 Kluger ..... 271/258.01
5,651,542 * 7/1997 Yamauchi et al. ..... 271/122

* cited by examiner

*Primary Examiner*—Eugene Eickholt

(57) ABSTRACT

A method for alerting a user when the time has arrived to replace a media feed roller on a printing device, employs statistical analysis of data gathered relating to the number of pages between misfeeds associated with the media feed roller. It has been ascertained that the misfeed rate associated with media feed roller failure follows a characteristic pattern, which may be treated as a step function. That is to say that, beginning with a new media feed roller, the feed failure rate, which is usually measured in pages printed between misfeeds, remains relatively constant. However, as the time for replacement nears, the graph begins to plunge precipitously, as misfeeds begin to occur with increasing regularity. After the plunge, the misfeed rate continues to increase, but at a decreasing rate. Eventually, the feed failure rate reaches a value that represents a misfeed during every page feed. The optimum time for replacement is deemed to be shortly after the graph begins to plunge. However, because there is a certain degree of randomness to the feed failure phenomenon, it is necessary that notification of the need for replacement of the media feed roller be given based on accumulated data sufficient to make a statistically valid directive to the printer user. The preferred method for providing a roller replacement directive to the user is to begin tracking feed failures when a feed failure rate value falls within a predetermined replacement range for the first time. After a statistically significant number of subsequent misfeeds indicate that the misfeed rate average is within the fixed replacement range, the replacement directive may be issued.

22 Claims, 3 Drawing Sheets

METHOD OF DETERMINING OPTIMUM TIME FOR REPLACING THE MEDIA FEED ROLLER OF A PRINTING DEVICE

FIELD OF THE INVENTION

This invention relates to printing devices and, more particularly, to the need to change feed rollers on such devices as the rollers wear and/or become contaminated with particles from abraded media.

BACKGROUND OF THE INVENTION

In the realm of peripheral equipment for data processing systems, it is difficult to think of a device that is more reliable than a modern laser or ink-jet printer. In spite of their inherent reliability, such printers do require rather infrequent periodic maintenance. One of the items that is subject to degradation with use is the media feed, or pick, roller that is responsible for grabbing a single sheet of print media from a paper storage tray or bin and feeding the sheet into a series of transport rollers which direct the sheet along a path within the printer. Various types of print media, such as bond paper, cotton-fiber bond paper, recycled paper and plastic transparencies, may be used, depending on the type of printer. Typically the media feed roller is either cylindrical or a section of a cylinder (i.e., pie-shaped when a cross section is taken perpendicular to the cylindrical axis). As a general rule, media feed rollers have a resilient rubber outer coating, layer or sleeve that has a high coefficient of friction. There are three main reasons why feed rollers must be periodically replaced. Firstly, with use, the outer surface of the roller gradually wears, thereby reducing its radius. As the radius decreases, the area of the roller which contacts the upper most sheet of a stack of print media sheets under an applied pressure during a media feed operation also decreases. As the area of contact decreases, so does the ability to reliably pick up individual print media sheets. Secondly, normal aging of the rubber compound by, for example, exposure to ozone in the atmosphere, can reduce the coefficient of friction. Thirdly, the media feed roller typically becomes contaminated with abraded media particles. Paper, the most common print medium, contains a potpourri of ingredients, which may include cellulose fibers; rosin (added as size to decrease the rate at which cellulose fibers absorb water); fillers such as clay, titanium dioxide, talc, and calcium carbonate (found chiefly in recycled paper from Europe); and various dyes. As paper is abraded by the feed roller, a some of the resulting cellulose and filler particles (e.g., clay, titanium dioxide) become embedded in the surface of the roller. Other abraded particles (most notably the abietic acid molecules from the rosin and the various organic molecules from which the dyes are formed) become dissolved within the rubber itself. Once dissolved, they freely migrate within the rubber, thereby changing the chemical and mechanical characteristics of the rubber. Contamination of the rubber on the media feed roller invariably reduces the coefficient of friction, making paper feed failures increasingly likely. Feed failures may be take several forms which may include: a complete failure to feed the media sheet, a late feed of the sheet, or a jam related to differential feed rates from one side of the sheet to the other. Collectively, these media feed failures will be referred to as misfeeds. Though the roller may be cleaned with an organic solvent such as alcohol, its coefficient of friction is unlikely to be restored to original specifications. Of course, contaminants dissolved within the rubber cannot be removed by a simple cleaning. At some point, the media feed roller must be replaced in order to minimize media misfeeds and restore printer performance.

The misfeed rate caused by media feed roller malfunction follows an interesting pattern. For a high-end printer with a new media feed roller, the feed failure rate will be around 1 misfeed per 10,000 pages, with replacement of the roller being made when the failure rate is greater than about 1 misfeed per 500 pages. Using print media of low abrasiveness and low pollutant content, this excessive jam rate will begin to occur when the roller has fed about 350,000. For a new low-end printer, a somewhat higher feed roller related feed failure rate of about 1 misfeed per 3,000 pages is considered acceptable, and replacement is usually made when the failure rate is greater than about 1 misfeed per 100 pages. With ideal use, the unacceptably-high misfeed rate will be reached when the roller has fed about 100,000 pages.

What is needed is a method for alerting the user or a network administrator of the need to replace a media feed roller. In most instances, it is not enough to simply alert the user after a total number of pages have been printed which correspond to the expected life of the roller under ideal service conditions. Due to greatly varied printing conditions, the roller may require replacement sooner.

SUMMARY OF THE INVENTION

This invention provides a method for determining the optimum time for replacing a media feed roller in a printing device, such as a printer used in connection with a data processing system, or a stand-alone copier. It has been ascertained that the misfeed rate associated with media feed roller failure follows a characteristic pattern, which may be treated as a step function. That is to say that, beginning with a new media feed roller, the feed failure rate, which is usually measured in pages printed between misfeeds, remains relatively constant. However, as the time for replacement nears, the graph begins to plunge precipitously, as misfeeds begin to occur with increasing regularity. After the plunge, the misfeed rate continues to increase, but at a decreasing rate. Eventually, the feed failure rate reaches a value that represents a misfeed during every page feed. Like most natural processes, there is a normal variation in feed failure rate. In addition, the curve may be linearly compressed by utilizing highly abrasive print media or print media high in contaminants, or linearly expanded by utilizing print media low in contaminants and low in abrasiveness. The optimum time for replacement is deemed to be shortly after the graph begins to plunge. However, because there is a certain degree of randomness to the feed failure phenomenon, it is necessary that notification of the need for replacement of the media feed roller be given based on accumulated data sufficient to make a statistically valid directive to the printer user, rather than making a directive based simply on one or a few data points that may be at the extremes of a normal distribution and, therefore, not representative of the true state of the media feed roller. The simplest and most reasonable technique for providing a roller replacement directive to the user is to begin tracking feed failures when a feed failure rate value falls within a predetermined replacement range for the first time. After a statistically significant number of subsequent misfeeds indicate that the misfeed rate average is within the fixed replacement range, the replacement directive may be issued. The message may take one or more of several forms, such as a synthesized voice warning, a warning message appearing on a digital readout, the turning on of a warning light, or the sounding of a buzzer. If the printer is installed on a network, notification may be sent to the user performing the printout, to the network server console, or to both locations. Another, more complex, method of determining the optimum time for roller replacement assumes that the misfeed rate is a function of the total number of pages printed. Thus, non-linear regression analysis may be performed on data points already recorded in order to extrapolate the expected shape of a future portion of the misfeed rate curve. Though the basic shape of the misfeed rate curve may be determined experimentally for each media feed roller type, the curve for use in the real world will vary for each printing device. The amount of variance from the experimentally determined curve will depend on the actual conditions of use (e.g., the mix of paper chemical composition and abrasiveness over the life of the roller). By tracking the misfeed rate, and by knowing the basic shape of the curve from data gathered under experimental conditions, it is possible to extrapolate what the curve will look like if printing media conditions remain relatively unchanged. The closer the portion of the curve that we are attempting to extrapolate is to the portion of the curve already determined from analysis of recorded data points, the more accurate this look-ahead extrapolation will be. The latter technique, though considerably more complex, may give an earlier warning of the need to change the media feed roller. However, as a practical matter, the former technique is more than adequate, as the time required for several misfeeds to occur after the media feed roller makes the transition from a condition of being barely acceptable to requiring replacement will most likely occur in a matter of hours if the printing device is being used anywhere near its maximum duty cycle. Thus, in the interest of reduced complexity and cost, the first method of determining the time of replacement is opined to be the preferred method.

DETAILED DESCRIPTION OF THE INVENTION

Figure 1:
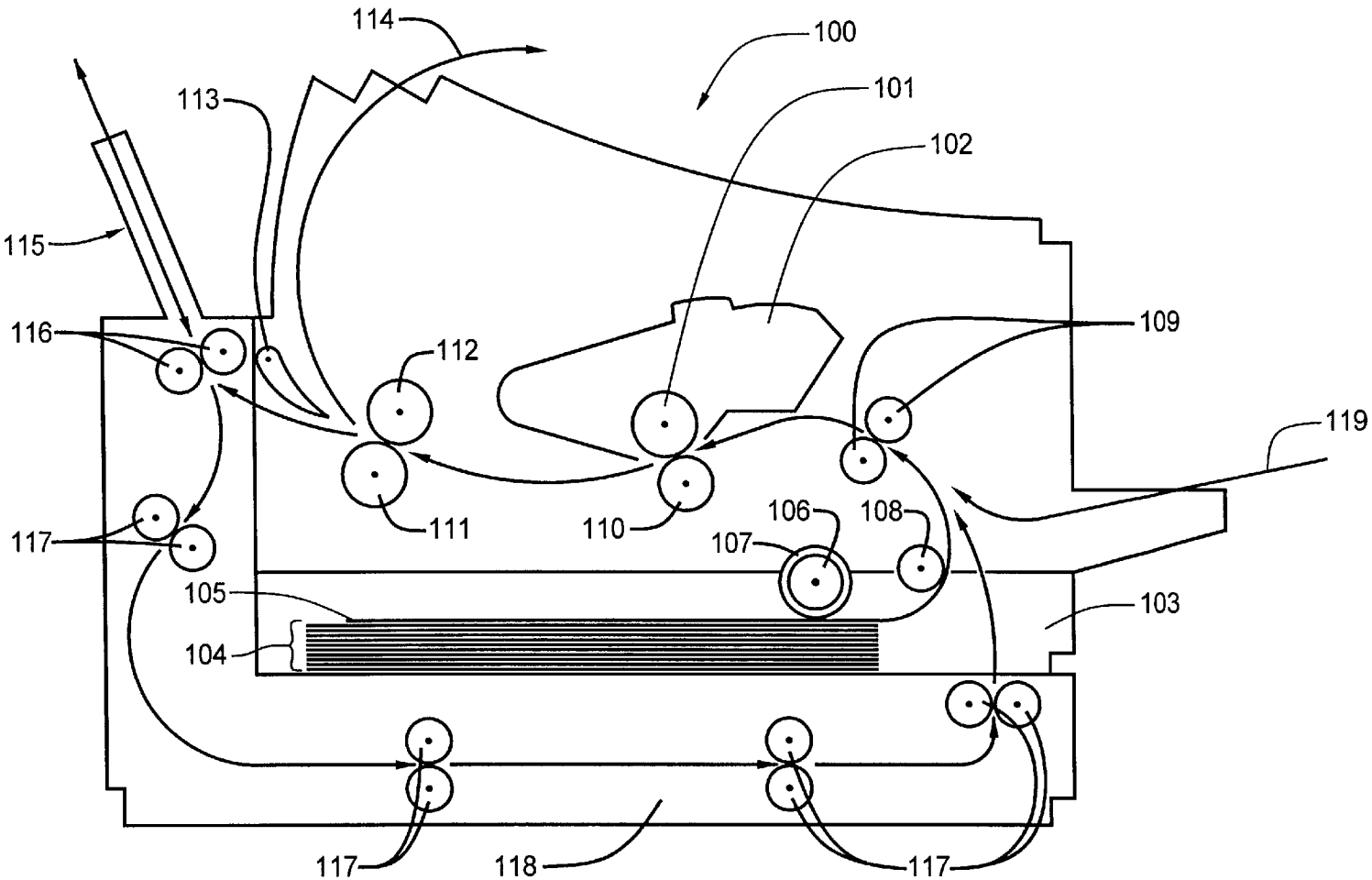
FIG. 1 is a see-through schematic view of a typical laser printer showing both the simplex and duplex paper paths.

Referring now to FIG. 1, the see-through schematic view of a laser printer 100 shows both simplex and duplex media feed paths. A photoconductive drum 101 is rotatably mounted within a toner cartridge assembly 102. In order to create a printable image, the drum 101 is rotated by a stepper motor (not shown) while a laser beam (also not shown) writes a latent electrostatic image thereon, one line at a time. Toner powder is then transferred from within the toner cartridge assembly 102 to the latent electrostatic image on the drum 101. A paper tray 103 provides storage for a stack 104 of singulated media sheets 105. Although xerographic bond paper is the most common print media used in laser printers, envelopes and polymeric transparencies are but two of other additional types of print media. Individual media sheets 105 are dislodged from the top of the stack 104 by a media feed roller 106. The pick-up surface of the media feed roller 106 is generally covered with a layer of resilient polymeric material 107, such as rubber. Passing over a guide roller 108, a dislodged media sheet 105 is fed between a pair of abutting, axially parallel registration rollers 109. The media sheet 105 then passes between the photoconductive drum 101 and a transfer roller 110 thereby transferring the toner powder image to the media sheet 105. As the image bearing media sheet 105 passes between a pressure roller 111 and a heated fuser roller 112, the image is fused onto the surface of the media sheet 105. A pivotable duplexing/simplexing guide 113, which operates much like a railway switch, directs the media sheet 105 having the fused image thereon either to a final exit path 114 for simplex printing, or to a switch back assembly 115 fitted with reversible duplexing rollers 116, which reverses the feed direction of the media sheet 105 for duplex printing. A series of paired transport rollers 117 transports the media sheet 105 to a holding tray 118 beneath the paper tray 103, where the media sheet remains until a new image is applied to the photoconductive drum 101, and then, again, to the registration rollers 109. The printing process then proceeds as before, with the new image being applied to the opposite side of the media sheet 105. This time, the fused sheet exits to the final exit path 114. A manual media feed path 119 may be used for little-used or odd-size media.

Figure 2:
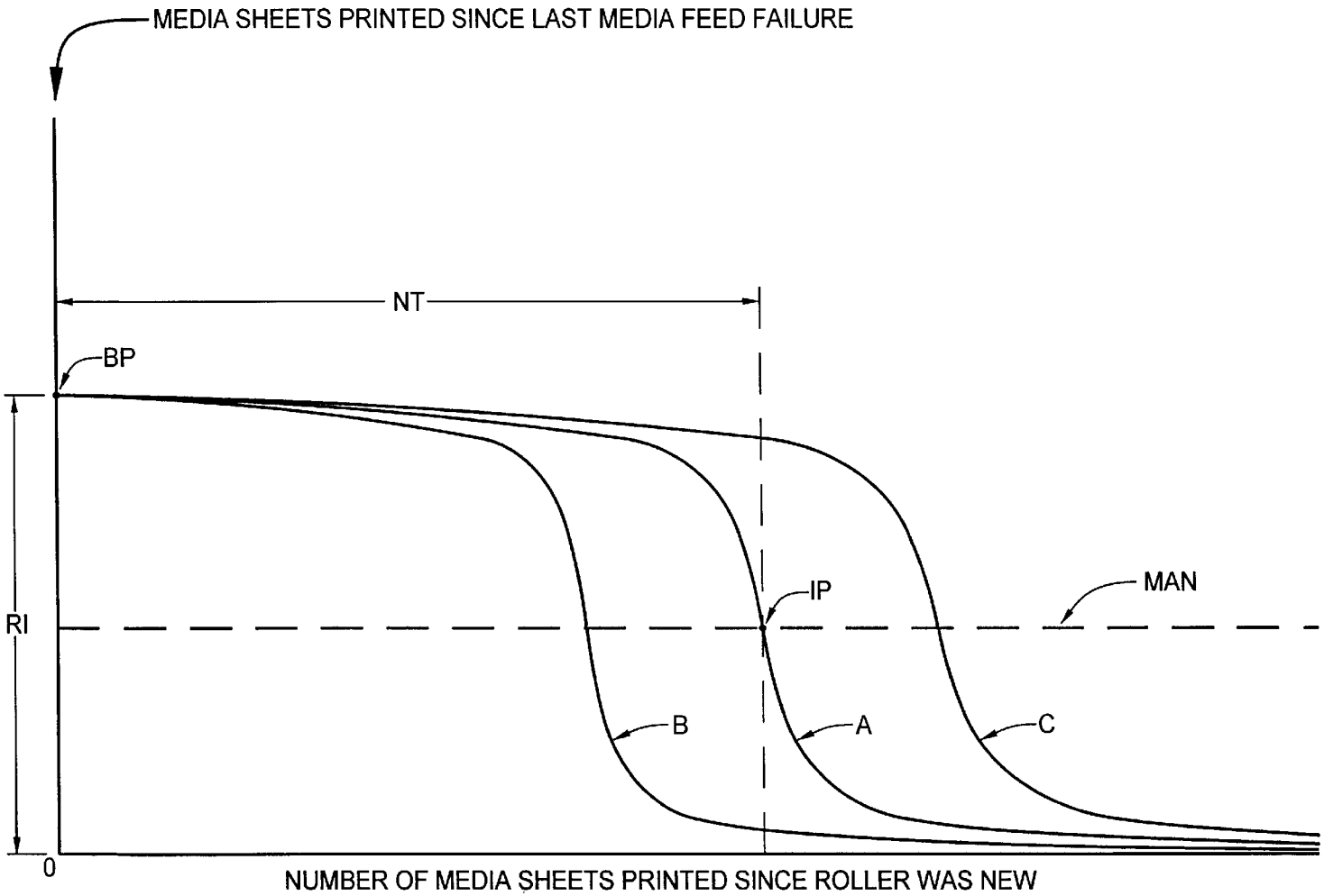
FIG. 2 is a representative graph of misfeed rate, measured in pages between misfeeds, versus the total number of pages printed since the media feed roller was new.

Referring now to FIG. 2, curve A shows an experimentally-derived graph of misfeed rate, measured in pages between misfeeds, as a function of the total number of pages printed since the media feed roller was new. Although the data points accumulated during the life of a single media feed roller are relatively few, if jam data for a large number of identical printers having identical media feed rollers, and loaded with identical media types, were compiled and plotted on the same axes during the life of the respective media feed rollers, a normal distribution of data points about this curve would result. For the purposes of this invention, curve A may be treated as a step function, consisting of a downwardly concave portion from the beginning point BP to an inflection point IP, followed by an upwardly concave portion thereafter. The misfeed rate, after increasing only gradually for most of its life, begins to plunge steeply as the coefficient of friction becomes marginal. At the inflection point IP, the rate of change begins to decrease, and the curve eventually approaches the horizontal axis, a misfeed rate value of zero, corresponding to a misfeed on every page feed. The inflection point IP is opined to be the preferred point at which roller replacement should be made. Because the rate of change in misfeed rate is highest at this point, misfeeds will be coming in increasingly rapid succession. The availability of multiple data points while printing relatively few pages makes this portion of the graph fairly simple to detect. In addition, replacement of the roller at or near the inflection point on the graph is believed to be a good compromise between economy and the desire to eliminate the nuisance of too-frequent misfeeds.

Curve A of FIG. 2 may be horizontally compressed by utilizing highly abrasive print media or print media high in contaminants. Curve B is the result of compression. Likewise, the curve may be horizontally expanded by utilizing print media low in contaminants and low in abrasiveness. Curve C represents a horizontal expansion of curve A. Although compressed or expanded, the curve retains its characteristic double-concave shape.

Still referring to FIG. 2, RI equals the initial misfeed rate of a new roller. As previously stated, this value can be about 1 feed failure per 10,000 pages for a high-end printer, and about 1 feed failure per 3,000 pages for a low-end printer. The minimum acceptable number of pages between feed failures, MAN, is the replacement limit. This value is set around 1 feed failure per 500 pages for a high-end printer; 1 feed failure in about 100 pages for a low-end printer. The life expectancy of a media feed roller in total number of pages printed is represented by the value NT. NT can equal 350,000 for a high-end printer; 100,000 for a low-end printer.

Because there is a certain degree of randomness to the feed failure phenomenon, it is necessary that notification of the need for replacement of the media feed roller be given based on accumulated data sufficient to make a statistically valid directive to the printer user, rather than making a directive based simply on one or a few data points that may be at the extremes of a normal distribution and, therefore, not representative of the state of the roller. The simplest technique for providing a roller replacement directive to the user is to begin tracking misfeed rates when a misfeed rate value falls within a predetermined replacement range for the first time. After a statistically significant number of subsequent misfeeds indicate that the misfeed rate average is within the fixed replacement range, the replacement directive may be issued. The message may take one or more of several forms, such as a synthesized voice warning, a warning message appearing on a digital readout, the turning on of a warning light, or the sounding of a buzzer. If the printer is installed on a network, notification may be sent to the user performing the printout, to the network server console, or to both locations. An enhancement of the foregoing detection procedure may include a statistical analysis of other recorded data. Several factors, such as the total number of pages printed since the roller was new and the trend of misfeed data recorded prior to a misfeed rate value falling into the replacement range, may be analyzed and checked for proper correlation. If the existence of misfeed rate data within the replacement range is not consistent with prior data trends, or misfeed data falling within the predetermined replacement range is occurring unusually early, this may be an indication of a problem not related to the condition of the rubber layer on the media feed roller. For example, screws may have loosened which allowed the media feed roller to become misaligned, or unapproved media having an unusually low coefficient of friction may have been loaded.

Another, more complex, method of determining the optimum time for roller replacement assumes that the misfeed rate is a function of the total number of pages printed since the media feed roller was new. Thus, the expected shape of a future portion of the curve may be extrapolated from data points already recorded. Referring once again to curve A of FIG. 2, it will be noted that the graph consists of a downwardly concave portion continuous with an upwardly concave portion, whereas a true step function would consist of two flat sections connected by a vertical section. Though the curve may be treated as a step function in order to simplify analysis, there is some indication that the misfeed rate may be most accurately described as a pair of interconnected exponential functions. However, whether or not an exponential correlation exists is not particularly important. What is important is that the slope appears to vary continuously. Although the basic shape of the curve for a particular media feed roller can be determined experimentally, it is not known how conditions unique to a particular user (e.g., paper chemical composition and abrasiveness) will affect the linear compression or expansion of the curve until a statistically significant number of data points have been accumulated, which may indicate the rate at which the curve is changing so that we can project approximately when it will plunge through the replacement line. With each new misfeed data point, the shape of the curve become increasing clear. In order to determine the shape and, of course, slope of the curve when a new misfeed occurs, non-linear regression analysis may be employed. Although such a technique may give an earlier warning and, thereby reduce to some degree the frustration level of users, as a practical matter, the time required for several misfeeds to occur after the media feed roller makes the transition from a condition of being barely acceptable to requiring replacement will most likely occur in a matter of hours if the printing device is being used anywhere near its maximum duty cycle. Thus, in the interest of reduced complexity, the first method of determining the time of replacement is opined to be the preferred method.

Figure 3:
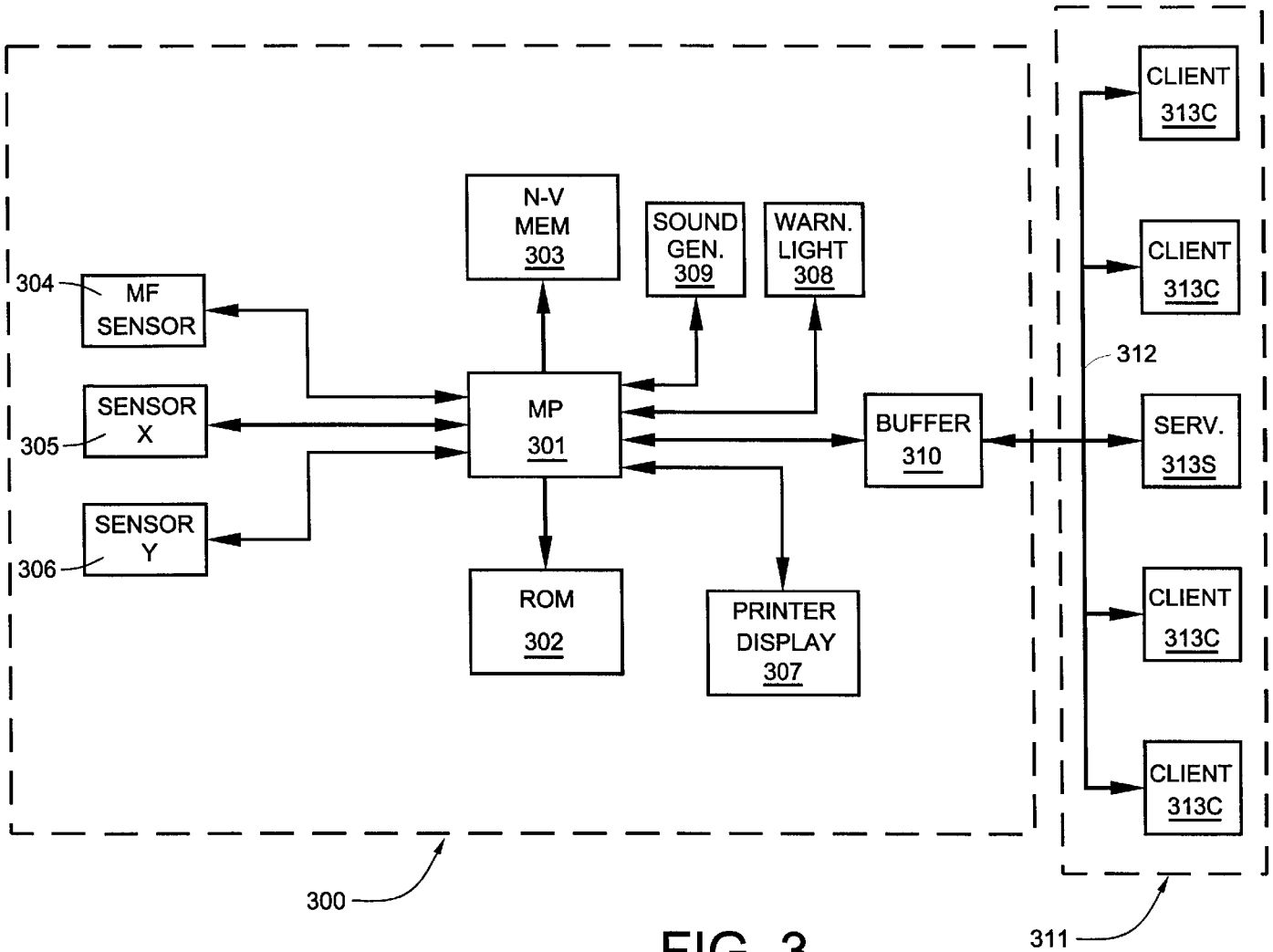
FIG. 3 is simplified block diagram of printer electronics required to implement the present invention.

Referring now to FIG. 3, in order to implement the invention on a hardware level, the printing device must be able to determine whether or not a misfeed situation is the result of a failure of the media feed roller. Implication of the media feed roller can usually be determined by a no feed or misfeed condition at the beginning of the print cycle. Many modern printers, including all high-end printers manufactured and sold by the Hewlett-Packard Co. are able to detect those conditions. In addition, typically, there are several such sensors on most modern printers. Not only is there a sensor to detect misfeeds, but internal jams and low-toner conditions as well. In FIG. 3, the printer electronics 300 include a misfeed sensor 304. Two additional sensors, sensor X 305 and sensor Y 306 detect other abnormal conditions during printer operation. The printer electronics also include a non-volatile memory 303 for storing operational data, such as the total number of sheets printed, the total number of pages printed for each print media size, the total number of misfeeds and/or jams for each media size, the total number of sheets printed when a jam or misfeed occurs data related to each misfeed. Optionally, for simplified tracking of misfeeds and/or jams related to the media feed roller, the printer may simply store values corresponding to the number of sheets printed since the last misfeed or jam. The printer electronics 300 also includes an on-board microprocessor 301 for processing the stored data, and coded routines stored within read-only memory (ROM) 302 for implementing the storage, processing and notification functions. As most contemporary printing devices have an on-board microprocessor 301, on-board non-volatile random access memory 303, and a ROM, the roller replacement notification method may be implemented with the addition of specialized code within the ROM 302. Notification of the misfeed condition is made by the microprocessor 301 either sending code for a displayable message stored within the ROM 302 to a printer display 307, by sending a signal which turns on a warning light 308 indicative of the condition, by sending a signal to a sound generator 309 that audibly warns the user, or by sending displayable code to the screen of a display monitor of a computer coupled to the printer. If the printing device 100 is coupled to a network 311 via a network data bus 312, the display screen may pertain to either a client system 313C, or it may pertain to the network server system 313S. Buffers which would ordinarily isolate the microprocessor 301 from the printer display 307, the warning light 308, and the sound generator 309 are not shown. A buffer 310 isolates the microprocessor 301 from the data bus 312.

Although only a single embodiment of the invention has been heretofore described, it will be obvious to those having ordinary skill in the art that changes and modifications may be made thereto without departing from the scope and the spirit of the invention as hereinafter claimed.

What is claimed is:

1. In combination with an electronic printing device having a media feed roller covered with a layer of resilient polymeric material, a method for determining when the roller has reached the end of its useful life and providing notice of the need to replace such a roller, said method comprising the steps of:

establishing a minimum acceptable number (MAN) of pages printed between media feed failures;

equipping the printing device with a non-volatile memory, a microprocessor, and a ROM for storing coded routines which implement the method at a hardware level;

providing a means for the printing device to identify all media feed failures associated with the media feed roller;

storing a data item related to at least those media feed failures which fall below said MAN, each data item sufficient for the microprocessor to determine the number of pages printed since the previous media feed failure;

employing the microprocessor to analyze stored data items in order to determine whether or not the roller has reached the end of its useful life; and providing notice that the roller is determined to be no longer usable.

2. The method of claim 1, wherein a determination of whether or not the roller has reached the end of its useful life is made by employing the microprocessor to analyze all data items, computing a best fit curve for all data items, and determining whether or not a latest recorded point on said best fit curve falls below said MAN.

3. The method of claim 1, wherein a data item is stored for each feed failure from the time the roller is new until it is replaced.

4. The method of claim 1, wherein a running tally of the total number of pages printed since the roller was new is maintained in said non-volatile memory.

5. The method of claim 1, wherein a determination of whether or not the roller has reached the end of its useful life is made by employing the microprocessor to analyze stored data items accumulated following the recording of any data item which falls below said MAN, in order to determine whether or not an average of the analyzed data items falls below said MAN.

6. The method of claim 5, which further comprises the step of analyzing all data items, computing a best fit for all data items, and determining that a feed failure falling below said MAN is an expected occurrence at that time, prior to notifying the user of the need to replace the media feed roller.

7. The method of claim 1, wherein notice is provided to a user via a printer-generated message on a printer display screen.

8. The method of claim 1, wherein notice is provided to a user by turning on a printer warning light.

9. The method of claim 1, wherein notice is provided to a user by an audible voice message generated by the printer.

10. The method of claim 1, wherein notice is provided by means of a message generated by the printer which is sent to a computer display screen.

11. The method of claim 10, wherein the message is sent to a server console if the printer is connected in a network environment.

12. In combination with an electronic printing device having a rubber-covered media feed roller, a method for determining when the roller has reached the end of its useful life and providing notice of the need to replace the roller, said method comprising the steps of:

establishing a minimum acceptable number (MAN) of pages printed between media feed failures;

equipping the printing device with a non-volatile memory, a microprocessor, and a ROM for storing coded routines which implement the method at a hardware level;

providing a means for the printing device to identify all media feed failures associated with the media feed roller;

storing a data item related to each media feed failure which falls below said MAN, each data item sufficient for the microprocessor to determine the number of pages printed since the previous media feed failure;

storing a data item related to each failure which follows a feed failure falling below said MAN;

employing the microprocessor to analyze the stored data items in order to determine whether an average of the stored data items falls below said MAN; and providing notice if said average falls below said MAN.

13. The method of claim 12, wherein a data item is stored for each feed failure from the time the roller is new until it is replaced.

14. The method of claim 13, wherein each data item further includes the total number of pages printed since the roller was new.

15. The method of claim 14, which further comprises the step of analyzing all data items, computing a best fit for all data items, and determining that a feed failure falling below said MAN is an expected occurrence at that time, prior to notifying the user of the need to replace the media feed roller.

16. The method of claim 12, wherein notice is given to a user via a printer-generated message on a printer display screen.

17. The method of claim 12, wherein notice is given to a user by the printer switching on a warning light thereon.

18. The method of claim 12, wherein notice is given to a user by means of an audible voice message generated by the printer.

19. In combination with an electronic printing device having a media feed roller covered with a layer of resilient polymeric material, a method for determining when the roller has reached the end of its useful life and providing notice of the need to replace the roller, said method comprising the steps of:

establishing a minimum acceptable number (MAN) of pages printed between media feed failures;

equipping the printing device with a non-volatile memory, a microprocessor, and a ROM for storing coded routines which implement the method at a hardware level;

providing a means for the printing device to identify all media feed failures associated with the media feed roller;

storing a data item related to each media feed failure, each data item each data sufficient for the microprocessor to determine the number of pages printed since the previous media feed failure;

employing the microprocessor to analyze all data items, computing a best fit curve for all data items; and notifying the user if said best fit curve falls below said MAN.

20. The method of claim 19, wherein notice is given to a user via a printer generated message on a printer display screen.

21. The method of claim 19, wherein notice is given to a user by switching on a warning light thereon.

22. The method of claim 19, wherein notice is given to a user by means of an audible voice message generated by the printer.

* * * * *